US011035556B2

(12) United States Patent
Proeber et al.

(10) Patent No.: US 11,035,556 B2
(45) Date of Patent: Jun. 15, 2021

(54) PORTABLE LIGHTING DEVICE

(71) Applicant: MILWAUKEE ELECTRIC TOOL CORPORATION, Brookfield, WI (US)

(72) Inventors: David Proeber, Milwaukee, WI (US); Gary Lee McMurray, Pewaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/387,637

(22) Filed: Apr. 18, 2019

(65) Prior Publication Data

US 2019/0331326 A1 Oct. 31, 2019

Related U.S. Application Data

(60) Provisional application No. 62/663,736, filed on Apr. 27, 2018.

(51) Int. Cl.

| | |
|---|---|
| ***F21V 21/096*** | (2006.01) |
| ***F21V 23/04*** | (2006.01) |
| ***F21V 21/088*** | (2006.01) |
| ***F21V 19/00*** | (2006.01) |
| ***F21L 4/02*** | (2006.01) |
| ***H01F 7/02*** | (2006.01) |
| *F21Y 115/10* | (2016.01) |

(52) U.S. Cl.

CPC ..... *F21V 21/0965* (2013.01); *F21L 4/02* (2013.01); *F21V 19/0035* (2013.01); *F21V 21/0885* (2013.01); *F21V 23/0414* (2013.01); *H01F 7/0252* (2013.01); *F21Y 2115/10* (2016.08)

(58) Field of Classification Search

CPC ..... F21V 21/0965; F21V 21/0885; F21L 4/02

See application file for complete search history.

(56) References Cited

U.S. PATENT DOCUMENTS

| | | | | |
|---|---|---|---|---|
| 5,871,272 | A | 2/1999 | Sharrah et al. | |
| 6,095,661 | A | 8/2000 | Lebens et al. | |
| 6,179,431 | B1 * | 1/2001 | Chien | F21L 4/02 362/184 |
| 6,231,370 | B1 * | 5/2001 | Morin | H01R 12/57 361/807 |
| 6,305,818 | B1 | 10/2001 | Lebens et al. | |
| 6,488,390 | B1 | 12/2002 | Lebens et al. | |
| 6,573,659 | B2 | 6/2003 | Toma et al. | |
| 6,808,287 | B2 | 10/2004 | Lebens et al. | |
| 7,186,000 | B2 | 3/2007 | Lebens et al. | |
| 7,186,002 | B2 * | 3/2007 | Matthews | F21L 4/027 362/204 |

(Continued)

FOREIGN PATENT DOCUMENTS

| | | |
|---|---|---|
| CN | 1230040 | 9/1999 |
| CN | 101146388 | 3/2008 |

(Continued)

*Primary Examiner* — William N Harris

(74) *Attorney, Agent, or Firm* — Michael Best & Friedrich LLP

(57) ABSTRACT

A portable lighting device includes a housing defining a longitudinal axis, a light source supported by the housing, and a power source positioned within the housing and coupled to the light source. The portable lighting device also includes a clip rotatably coupled to the housing, and a magnetic element coupled to the housing.

20 Claims, 13 Drawing Sheets

(56) References Cited

U.S. PATENT DOCUMENTS

| | | | | |
|---|---|---|---|---|
| 7,196,477 | B2 | 3/2007 | Richmond | |
| D541,962 | S | 5/2007 | Bayat et al. | |
| D544,620 | S | 6/2007 | Son | |
| D554,781 | S | 11/2007 | Shiu | |
| 7,344,270 | B2 * | 3/2008 | Kim | F21V 23/0421 362/205 |
| 7,393,119 | B2 | 7/2008 | Lebens et al. | |
| 7,429,827 | B2 | 9/2008 | Richmond | |
| 7,517,107 | B2 | 4/2009 | Dallas et al. | |
| 7,740,371 | B1 | 6/2010 | Lebens et al. | |
| 7,850,330 | B2 | 12/2010 | Spartan et al. | |
| 7,888,883 | B2 | 2/2011 | Crawford et al. | |
| 7,942,553 | B2 | 5/2011 | Huang | |
| 7,959,317 | B2 | 6/2011 | Spartano et al. | |
| 8,063,607 | B2 | 11/2011 | Crawford et al. | |
| 8,104,915 | B1 | 1/2012 | Osterhout et al. | |
| 8,115,492 | B2 | 2/2012 | Crawford et al. | |
| 8,120,268 | B2 | 2/2012 | Spartano et al. | |
| 8,134,300 | B2 | 3/2012 | Maglica et al. | |
| 8,159,146 | B1 | 4/2012 | Lebens et al. | |
| 8,197,085 | B2 | 6/2012 | Spartano | |
| 8,324,836 | B2 | 12/2012 | Crawford et al. | |
| 8,362,700 | B2 | 1/2013 | Richmond | |
| 8,362,712 | B1 | 1/2013 | Lebens et al. | |
| 8,414,142 | B2 | 4/2013 | Tucker et al. | |
| 8,628,210 | B2 | 1/2014 | Tucker et al. | |
| 8,643,305 | B2 | 2/2014 | Lebens et al. | |
| 8,717,034 | B2 | 5/2014 | Crawford et al. | |
| 8,727,561 | B2 | 5/2014 | Sharrah et al. | |
| D708,376 | S | 7/2014 | Crowe et al. | |
| 8,779,683 | B2 | 7/2014 | Snyder et al. | |
| 8,810,191 | B2 | 8/2014 | Maldonado | |
| D713,076 | S | 9/2014 | von Waldthausen | |
| 8,829,808 | B1 | 9/2014 | Lebens et al. | |
| 8,853,951 | B2 | 10/2014 | Garcia | |
| 8,866,392 | B2 | 10/2014 | Chen | |
| D721,841 | S | 1/2015 | Kwon et al. | |
| 8,975,822 | B2 | 3/2015 | Maglica et al. | |
| D731,687 | S | 6/2015 | Haws | |
| 9,101,022 | B2 | 8/2015 | Hoffman et al. | |
| 9,119,266 | B1 | 8/2015 | Lebens et al. | |
| D739,063 | S | 9/2015 | Su | |
| D742,568 | S | 11/2015 | Abernethy | |
| 9,179,520 | B2 | 11/2015 | Trattler | |
| 9,252,613 | B2 | 2/2016 | Kugel et al. | |
| 9,447,951 | B2 | 2/2016 | Maglica et al. | |
| D757,318 | S | 5/2016 | Evans | |
| D764,087 | S | 8/2016 | Workman et al. | |
| D766,477 | S | 9/2016 | Ma | |
| 9,549,454 | B2 | 1/2017 | Maglica et al. | |
| 9,801,256 | B2 | 10/2017 | Maglica et al. | |
| D805,666 | S | 12/2017 | Nguyen et al. | |
| D806,923 | S | 1/2018 | Koshiba | |
| D810,335 | S | 2/2018 | Levy et al. | |
| D819,245 | S | 5/2018 | Gerza | |
| D821,007 | S | 6/2018 | Chen | |
| 10,001,252 | B2 * | 6/2018 | Inskeep | H05B 45/00 |
| D831,248 | S | 10/2018 | Kuhls | |
| D854,207 | S | 7/2019 | Zheng | |
| D855,228 | S | 7/2019 | Cooper et al. | |
| D857,958 | S | 8/2019 | Willows et al. | |
| D858,830 | S | 9/2019 | Grandadam | |
| D858,831 | S | 9/2019 | Proeber | |
| D858,833 | S | 9/2019 | Cooper | |
| D858,837 | S | 9/2019 | Vazquez et al. | |
| D861,209 | S | 9/2019 | Cooper | |
| 2003/0076051 | A1 | 4/2003 | Bowman et al. | |
| 2003/0234778 | A1 | 12/2003 | Kim | |
| 2006/0043911 | A1 | 3/2006 | Shao et al. | |
| 2006/0072306 | A1 | 4/2006 | Woodyard | |
| 2006/0109662 | A1 | 5/2006 | Reiff et al. | |
| 2007/0014103 | A1 | 1/2007 | Teng et al. | |
| 2008/0225518 | A1 | 9/2008 | Devaney et al. | |
| 2008/0258642 | A1 | 10/2008 | Patel | |
| 2008/0304254 | A1 | 12/2008 | Canino et al. | |
| 2009/0085502 | A1 | 4/2009 | Geris et al. | |
| 2010/0084997 | A1 | 4/2010 | Oberzeir et al. | |
| 2012/0033412 | A1 * | 2/2012 | Molina | F21V 21/088 362/119 |
| 2012/0182723 | A1 * | 7/2012 | Sharrah | F21V 29/004 362/157 |
| 2012/0182727 | A1 | 7/2012 | Sharrah et al. | |
| 2012/0182748 | A1 | 7/2012 | McCaslin et al. | |
| 2012/0236551 | A1 * | 9/2012 | Sharrah | G01R 31/392 362/204 |
| 2012/0286940 | A1 * | 11/2012 | Carmen, Jr. | H01H 9/0235 340/12.5 |
| 2013/0258649 | A1 | 10/2013 | Mueckl et al. | |
| 2015/0131276 | A1 * | 5/2015 | Thompson | F21V 21/096 362/191 |
| 2015/0247628 | A1 | 9/2015 | Li | |
| 2015/0267902 | A1 * | 9/2015 | Zhang | F21L 4/04 362/188 |
| 2016/0061429 | A1 | 3/2016 | Waalkes et al. | |
| 2016/0128151 | A1 | 5/2016 | Luick et al. | |
| 2016/0265754 | A1 | 9/2016 | Sun | |
| 2017/0284646 | A1 * | 10/2017 | Arena | F21V 23/06 |
| 2017/0292659 | A1 * | 10/2017 | Bayat | F21V 23/0428 |
| 2018/0027627 | A1 | 1/2018 | Maglica et al. | |
| 2018/0156427 | A1 | 6/2018 | Bailey et al. | |
| 2018/0224077 | A1 | 8/2018 | Bian | |

FOREIGN PATENT DOCUMENTS

| | | |
|---|---|---|
| CN | 201360368 | 12/2009 |
| CN | 1467994 | 1/2014 |
| CN | 203942676 | 11/2014 |
| EP | 2827684 | 1/2015 |
| KR | 2020160002590 U | 7/2016 |
| WO | 2012158383 A2 | 11/2012 |
| WO | 2016134396 A2 | 9/2016 |
| WO | 2017031586 A1 | 3/2017 |

* cited by examiner

PORTABLE LIGHTING DEVICE

CROSS-REFERENCE TO RELATED APPLICATIONS

The present application claims priority to U.S. Provisional Application No. 62/663,736, filed Apr. 27, 2018, the entire contents of which are incorporated by reference herein.

FIELD

The present invention relates to lighting devices. More specifically, the present invention relates to portable lighting devices that are operable to provide personal lighting to a user.

SUMMARY

In one embodiment, the invention provides a portable lighting device including a housing defining a longitudinal axis, a light source supported by the housing, and a power source positioned within the housing and coupled to the light source. The portable lighting device also includes a clip rotatably coupled to the housing, and a magnetic element coupled to the housing.

In another embodiment, the invention provides a portable lighting device including a housing defining a longitudinal axis, a first support mechanism coupled to the housing, a second support mechanism coupled to the housing, and a light source supported by the housing. The light source is configured to be supported in a plurality of orientations by the first and the second support mechanisms. The portable lighting device also includes a power source positioned within the housing and coupled to the light source.

In yet another embodiment, the invention provides a portable lighting device including a housing defining a longitudinal axis, a light source supported by the housing, and a power source positioned within the housing and coupled to the light source. The portable lighting device also includes a clip rotatably coupled to the housing, a first magnetic element coupled to the housing, and a second magnetic element coupled to the housing.

In still another embodiment, the invention provides a portable lighting device including a housing, a light source supported by the housing, a power source positioned within the housing and coupled to the light source, and a controller positioned within the housing and coupled to the light source and the power source. The controller is operable to execute a ramp-up algorithm to optimize an intensity of light outputted by the light source in relation to a remaining charge in the power source.

Other aspects of the disclosure will become apparent by consideration of the detailed description and accompanying drawings.

DETAILED DESCRIPTION

Before any embodiments of the invention are explained in detail, it is to be understood that the application is not limited to the details of construction and the arrangement of components set forth in the following description or illustrated in the following drawings. The application is capable of other embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly to encompass both direct and indirect mountings, connections, supports, and couplings.

As described herein, terms such as "front," "rear," "side," "top," "bottom," "above," "below," "upwardly," "downwardly," "inward," and "outward" are intended to facilitate the description of the lighting device of the application, and are not intended to limit the structure of the application to any particular position or orientation.

Figure 1:
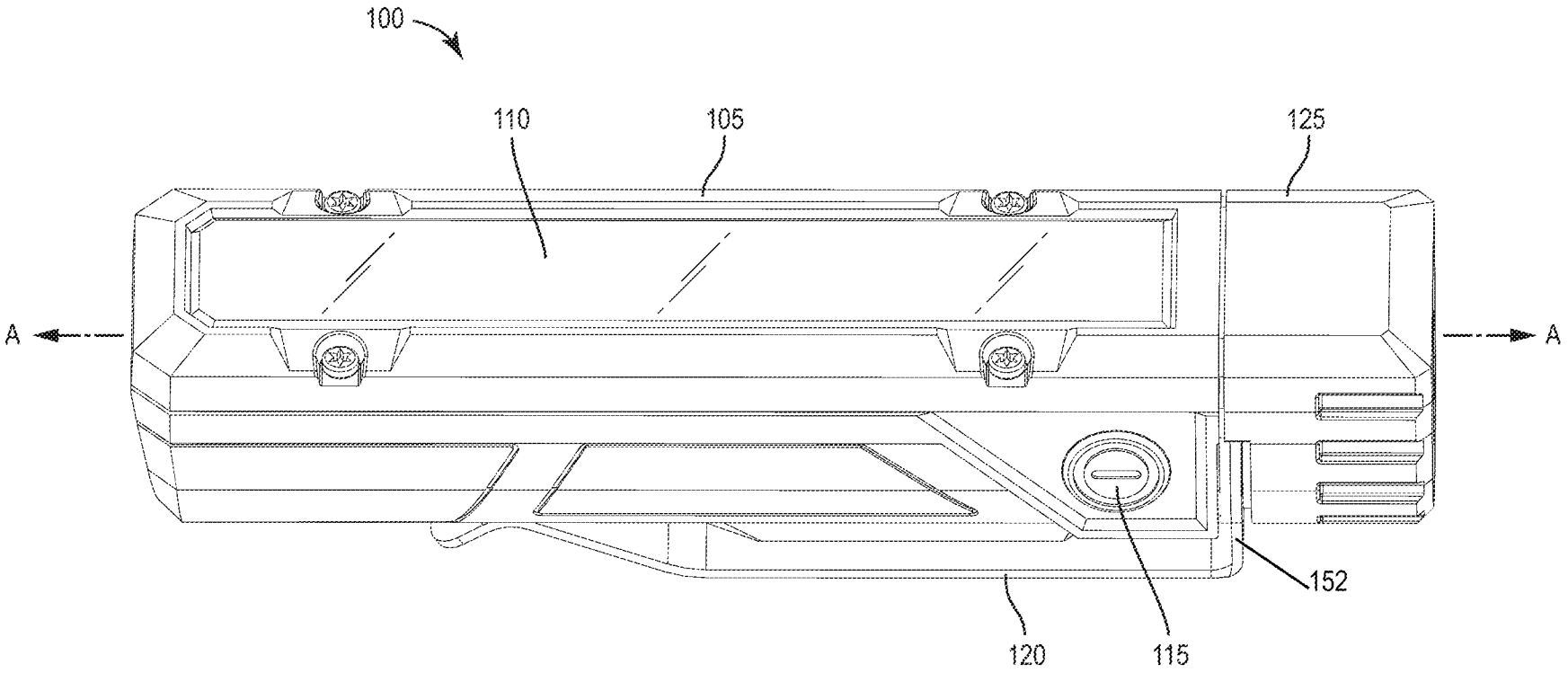
FIG. 1 is a perspective view of a portable lighting device including a light source.

FIG. 1 illustrates a portable lighting device 100, such as a personal floodlight or flashlight, including a housing 105, a light source 110, a power actuator (e.g., button) 115, and a clip 120. The housing 105 has a generally elongated cuboidal shape with a rectangular or square cross-section. The housing 105 defines a central longitudinal axis A extending through opposing ends of the housing 105. In other embodiments, the housing 105 may be configured as other geometric shapes. The housing 105 supports and encloses the other components of the lighting device 100.

Figure 2:
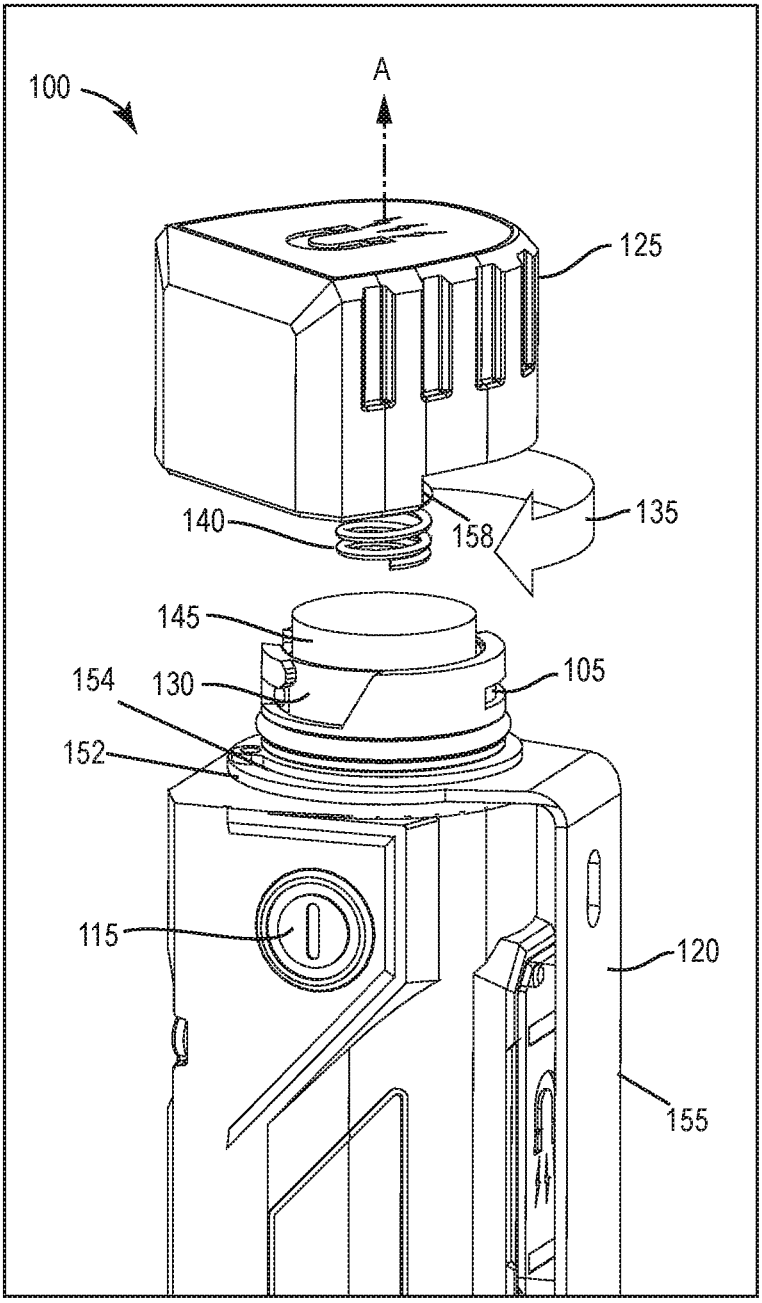
FIG. 2 is an end perspective view of the lighting device with a battery cap removed.

Referring to FIG. 2, the housing 105 includes a battery cap 125 at one end of the lighting device 100. The battery cap 125 is selectively removable from the remainder of the housing 105 via a locking mechanism 130. In the illustrated embodiment, the locking mechanism 130 is a bayonet-style locking mechanism, allowing the battery cap 125 to removably couple to the housing 105 via a clockwise or counterclockwise twisting motion (e.g., in the direction of arrow 135). In other or additional embodiments, the locking mechanism may be any suitable locking mechanism. When coupled to the remainder of the housing 105, the battery cap 125 encloses a power source 145 (e.g., a battery or battery pack) for powering the lighting device 100. The battery cap 125 further includes a biasing element 140. In the illustrated embodiment, the biasing element 140 is a coil spring, although other types of biasing elements may also or additionally be used. When the battery cap 125 is coupled to the housing 105 via the locking mechanism 130, the biasing element 140 compresses and applies a force along the longitudinal axis A on the power source 145. The force helps maintain the power source 145 in proper electrical connection with electrical contacts within the housing 105 to operate the light source 110.

Figure 3:
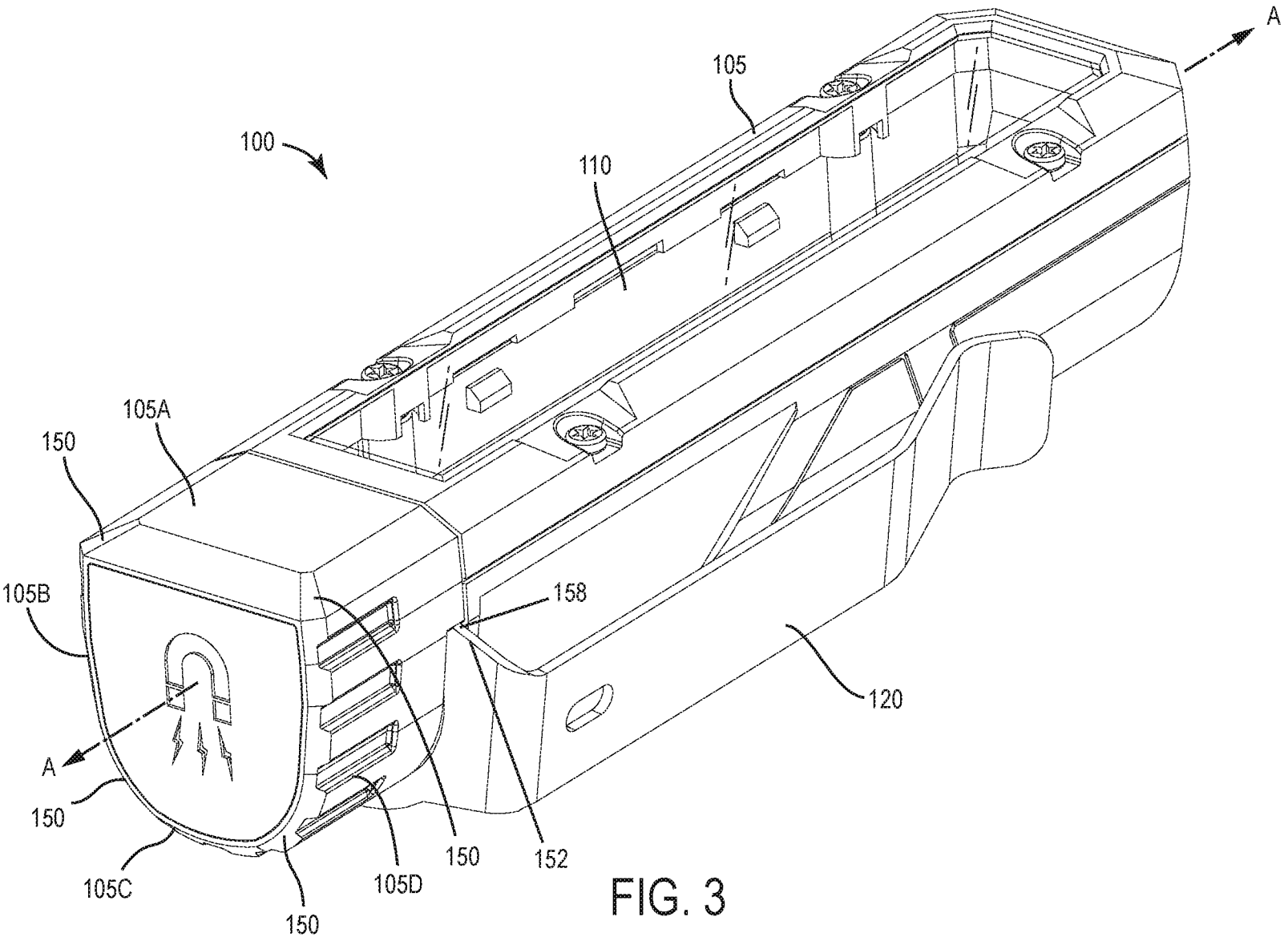
FIG. 3 is a perspective view of the lighting device positioned on a support surface in a first configuration.

Referring to FIG. 3, the housing 105 also includes a plurality of longitudinally-extending surfaces 105A, 105B, 105C, 105D arranged around the longitudinal axis A. The surfaces 105A-105D extend generally parallel to the longitudinal axis A and meet at corner areas 150 to form the generally elongated cuboid shape of the housing 105. In the illustrated embodiment, the corner areas 150 are configured as slanted edges disposed on the housing 105 along each of the four longitudinal edges parallel to the longitudinal axis A. The surfaces 105A-105D are oriented at different angles relative to each other to support the lighting device 100 at different orientations. For example, the lighting device 100 may be positioned on a support surface (e.g., a table) with a different one of the surfaces 105A-105D resting on the support surface to direct light from the light source 110 in various directions. Although the illustrated housing 105 includes four longitudinally-extending surfaces 105A-105D arranged at different angles, in other embodiments the housing 105 may include fewer or more longitudinally-extending surfaces.

Figure 5:
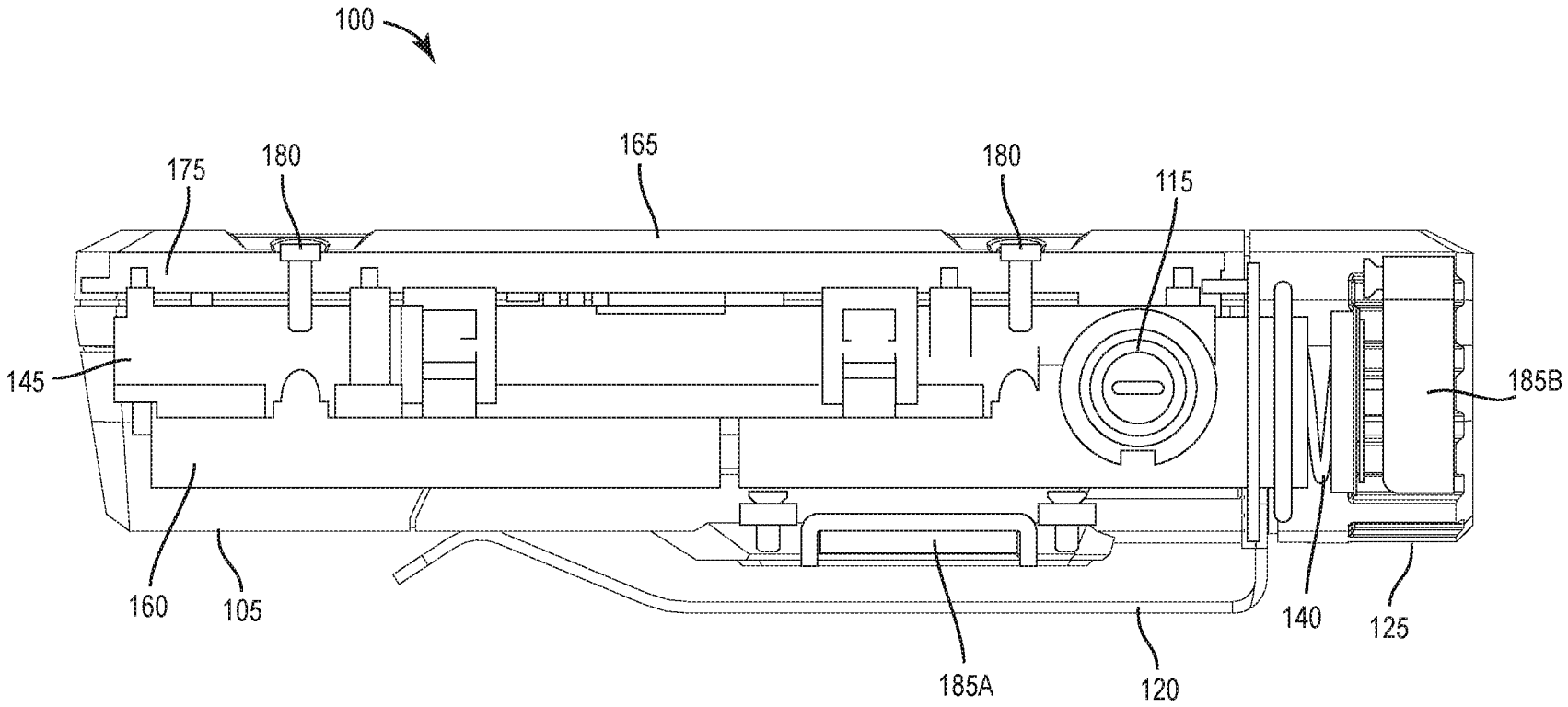
FIG. 5 is a cross-sectional view of the lighting device taken along section line 5-5 of FIG. 1.

FIG. 5 illustrates various internal lighting components comprising the lighting device 100. The housing 105 encases a carrier 160, which receives the power source 145. The housing 105 is held together around the carrier 160 by threaded fasteners 180 (e.g., screws). In other embodiments, other suitable fastening means, such as a snap-fit housing assembly and/or adhesives, may be used to assemble the housing 105.

Figure 6:
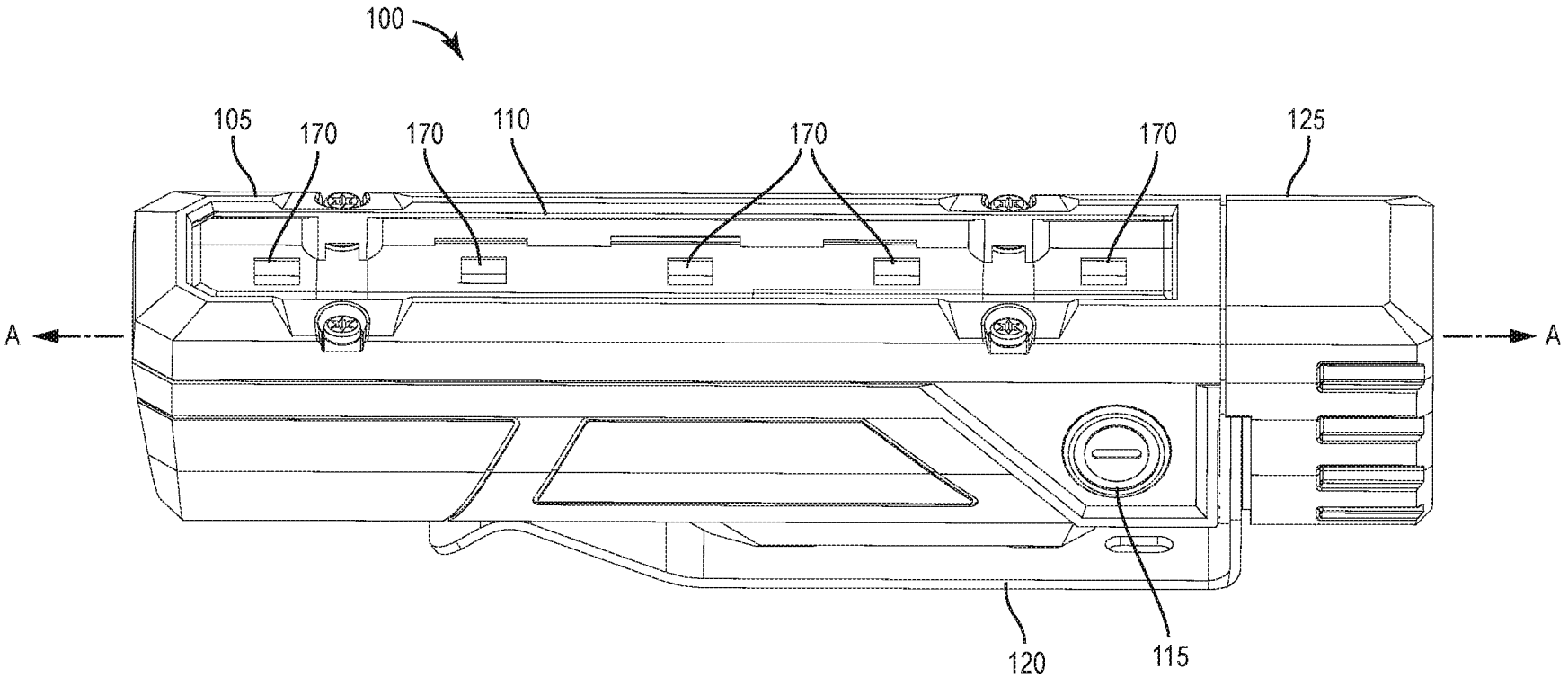
FIG. 6 is a perspective view the lighting device with a lens of the light source removed.
Figure 9:
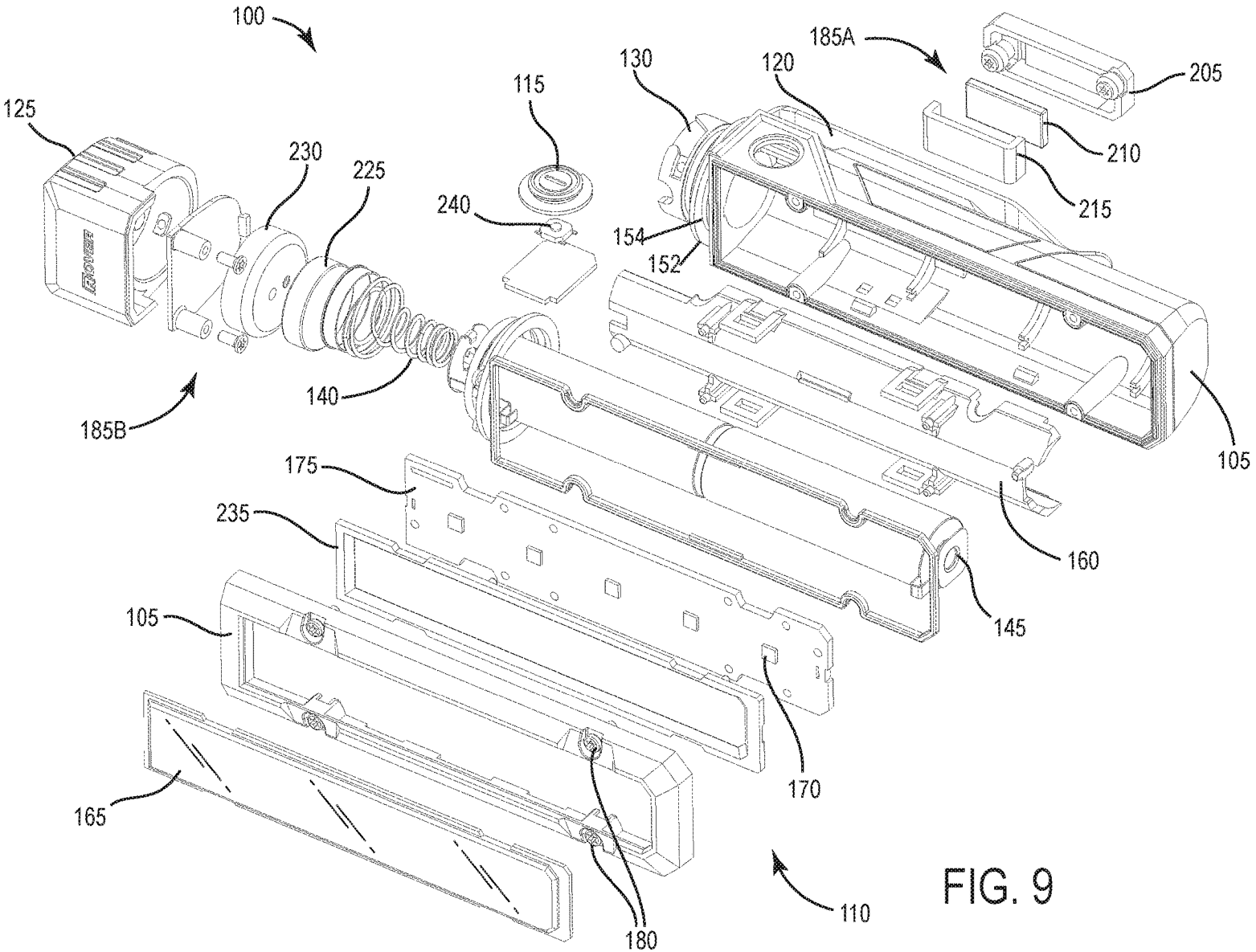
FIG. 9 is another exploded view of the lighting device.

As shown in FIGS. 5, 6, and 9, the light source 110 is supported by the housing 105 and configured to emit light in an outward direction that is normal to the longitudinal axis A. In other embodiments, the light source 100 may emit light along the direction of the longitudinal axis A or in various other directions relative the housing 105. The light source 110 includes a lens 165 and a plurality of light emitting elements 170. In the present embodiment, the lens 165 is a clear, injection molded plastic piece with a light refraction index that enhances the transmission of light emitted by the light emitting elements 170. In other embodiments, other materials may be used as the lens 165 to achieve different refraction indexes and different transmission factors.

The illustrated light emitting elements 170 are light emitting diodes (LEDs). In the illustrated embodiment, the light source 110 includes five LEDs 170 (shown in FIG. 6) disposed on a printed circuit board (PCB) 175. In other embodiments, the light source 110 may include fewer or more light emitting elements, and/or may include different types of light emitting element (e.g., florescent bulbs, incandescent bulbs, etc.). For example, in some embodiments, the lighting device 100 may be a personal flashlight that only includes one LED. In the present embodiment, the LEDs 170 are driven in synchronism with a relatively constant current or voltage. In other embodiments, the LEDs 170 may be driven separately and with a variable current or voltage.

The PCB 175 is powered by the power source 145 and supplies a variable drive current from the power source 145 to the LEDs 170. In some embodiments, the PCB 175 includes a controller or processor configured to generate a pulse width modulated (PWM) signal that drives the LEDs 170. The controller is operable to vary the PWM duty cycle to adjust the intensities of the LEDs 170 depending on the operation mode (e.g., HIGH mode, LOW mode, etc.) selected by the user via the power button 115. In other embodiments, the PCB or other suitable circuitry may generate different types of signals or drive currents to power the LEDs 170 in different modes. Furthermore, the controller is operable to implement a light optimizing control algorithm that monitors a remaining voltage in the power source 145, which is then used in a control loop to achieve a lumen output that can be supported by the current discharge state of the power source 145. Details of the controller and control algorithm will be described in further detail in the following description.

FIG. 9 shows a reflector 235 disposed between the lens 165 and the PCB 175. The reflector converges or diverges the light emitted by the LEDs 175 such that the lighting device 100 may achieve a desired intensity and output beam angle. The properties of the reflector 235 may be altered in various embodiments to achieve different light output characteristics.

Referring to FIGS. 1 and 9, the power button 115 is supported by the housing 105 and disposed above a switch 240. The switch 240 is electrically coupled between the power source 145 and the light source 110 (more particularly, the PCB 175 of the light source 110). When the power button 115 is depressed, the power button 115 actuates the switch 240 to select an operation mode of the lighting device 100. The selected operation mode is then electrically transmitted and temporarily stored in the PCB 175. Based on the stored operation mode, the PCB 175 executes a control algorithm to drive the LEDs 175 with a drive current from the power source 145. When the power button 115 is depressed, the lighting device 100 cycles between an OFF mode, a HIGH mode, a LOW mode, and back to the OFF mode. If the power button 115 is continuously depressed for an extended period of time exceeding a predetermined time, the lighting device will exit to the OFF mode regardless of the current mode or the next mode in the operation cycle.

Figure 4:
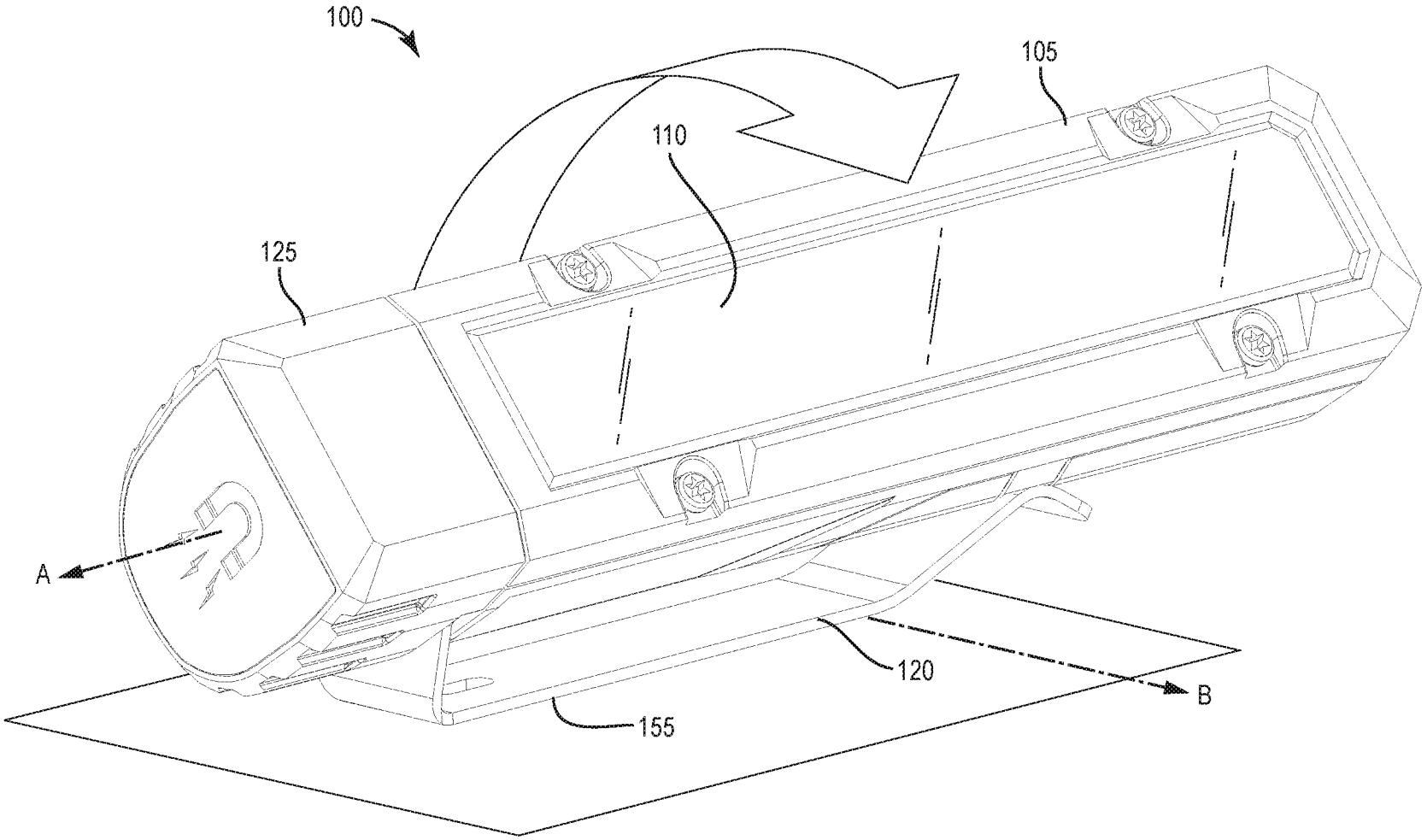
FIG. 4 is a perspective view of the lighting device positioned on the support surface in a second configuration.

As shown in FIGS. 3 and 4, the clip 120 is rotatably coupled to the housing 105. The clip 120 is operable to clip to various objects (e.g., a belt, etc.) to provide added portability and convenience to the lighting device 100. The clip 120 is rotatable about the longitudinal axis A to provide added stability and structural support as a kickstand for the lighting device 100 when the housing 105 rests on one of the longitudinally-extending surfaces 105A-105D (see FIG. 3). The clip 120 also has a coupling section 152 that couples to the housing 105, and a substantially flat section 155 that extends from the coupling section and that serves as a stand or a resting surface when the clip 120 (instead of one of the longitudinally-extending surfaces 105A-105D) is rotated with respect to the housing 105 to rest on the support surface (see FIG. 4). With respect to FIG. 9, the coupling section 152 includes an aperture 154 through which a portion of the housing 105 extends such that the coupling section 152 is positioned adjacent the locking mechanism 130. Moreover, the clip 120 is configured to rotate between a first position in which the clip 120 (e.g., the substantially flat section 155) is positioned adjacent a first of the longitudinally-extending surfaces 105A-105D of the housing 105, a second position in which the clip (e.g., the substantially flat section 155) is positioned adjacent a second of the longitudinally-extending surfaces 105A-105D (FIG. 3), and an intermediate position in which the clip 120 (e.g., the substantially flat section 155) is positioned adjacent the first and second positions (FIGS. 1 and 2). In the first and second positions, the clip 120 (e.g., the coupling section 152) abuts stop surfaces 158 on opposite sides of the battery cap 125, which provide extra support for the clip 120. In the illustrated embodiment, the clip 120 has a plurality of intermediate positions. For example, the clip 120 has a first intermediate position in which the substantially flat section 155 is positioned adjacent a third of the longitudinally-extending surfaces 105A-105D of the housing 105, a second intermediate position in which the substantially flat section 155 is positioned in between two longitudinally-extending surfaces 105A-105D, and a third intermediate position in which the substantially flat section 155 is positioned between two other longitudinally-extending surfaces 105A-105D (FIG. 4). In use, the clip 120 supports the entire weight of the lighting device 100 independent of the longitudinally-extending surfaces 105A-105D, allowing the lighting device 100 to rotate while being supported by the clip 120 and to emit light from the light source 110 at different angles determined by the position of the clip 120 relative to the housing 105 as specified by a user.

Figure 7A:
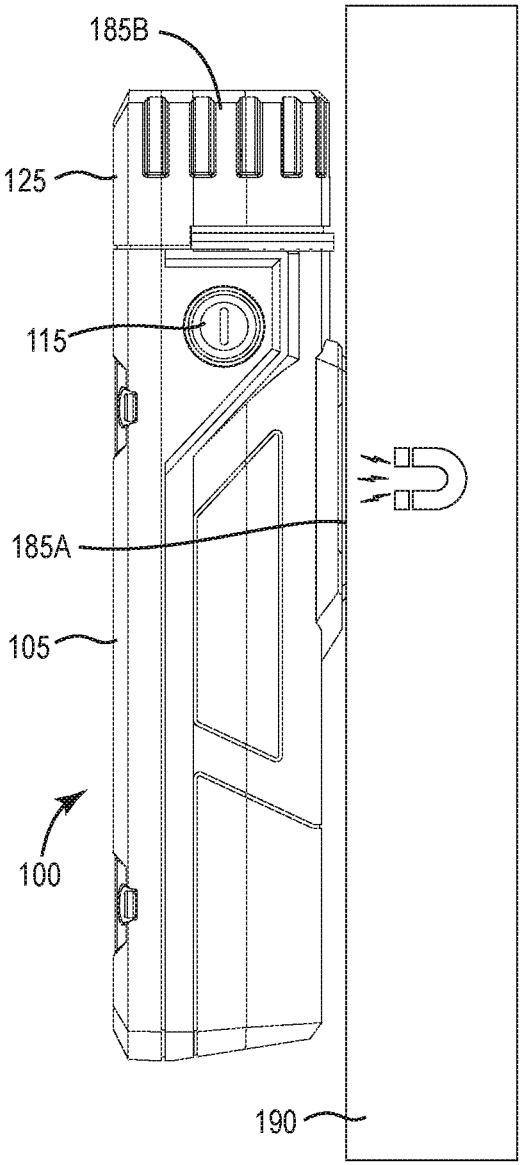
FIGS. 7A-7B illustrate configurations of the lighting device magnetically attached to a magnetic surface.
Figure 7B:
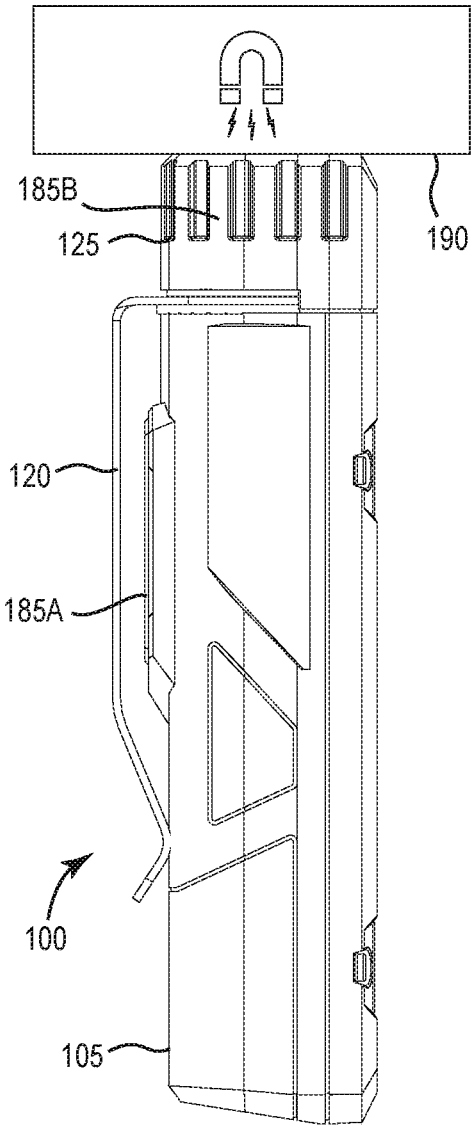
Figure 8:
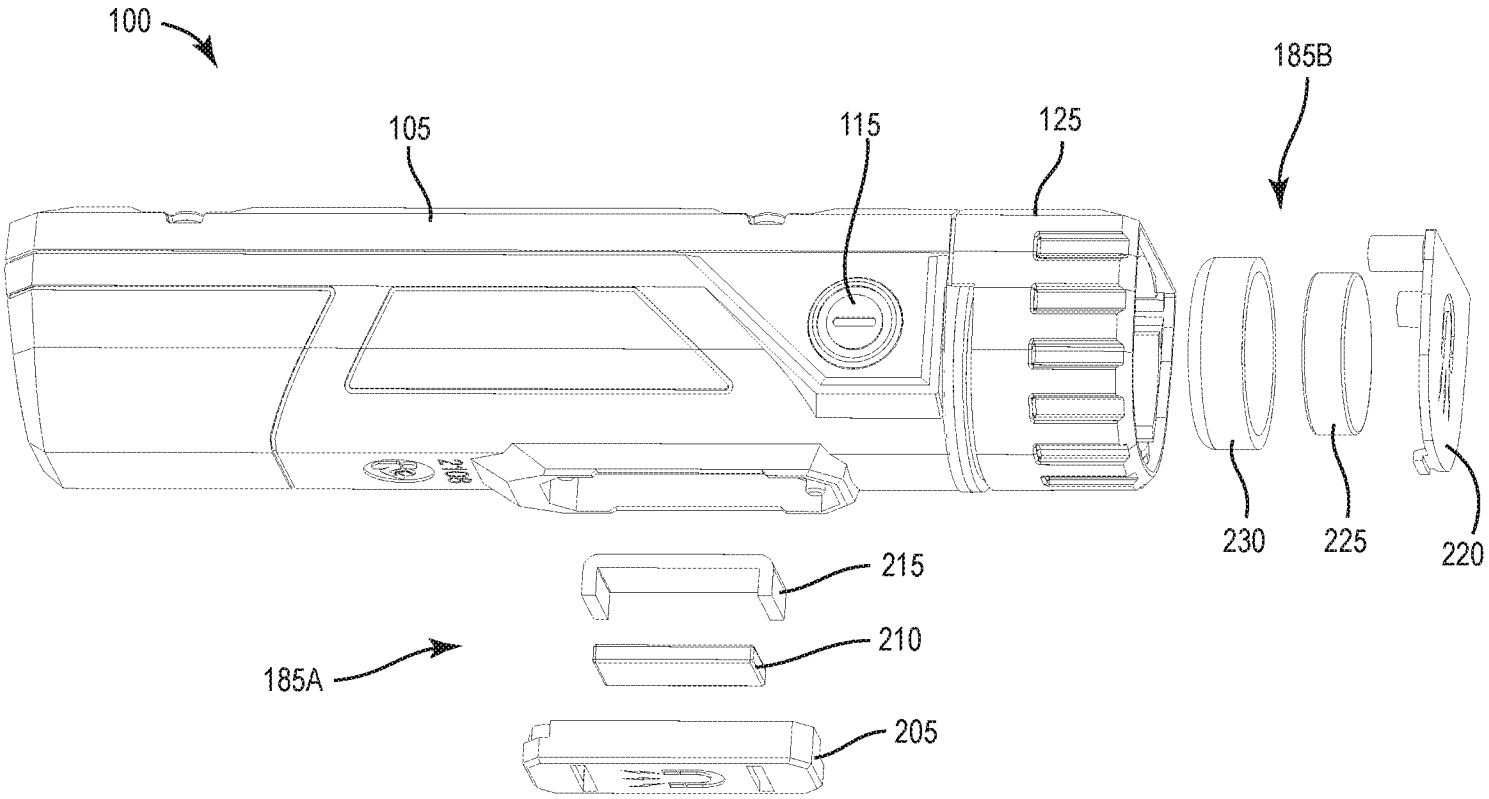
FIG. 8 is an exploded view of the lighting device, illustrating magnetic elements.

As shown in FIGS. 7A, 78, and 8, the lighting device 100 further includes two magnetic elements 185A, 185B. The first magnetic element 185A is a side magnet disposed on a side of the housing 105 opposite from the light source 110. The second magnetic element 185B is a cap magnet disposed in the battery cap 125. The magnetic elements 185A, 185B are capable of magnetizing and attracting to magnetic surfaces 190. The magnetic faces 185A 185B, thereby, allow the lighting device 100 to be conveniently mounted to magnetic surfaces 190 in various orientations. In some embodiments, the first magnetic element 185A, the second magnetic element 185B, or both may be omitted.

FIG. 8 is an exploded view of the magnetic elements 185A, 185B of the lighting device 100. The first magnetic element 185A includes a side magnet cover 205, a first magnet 210, and a side magnetizer 215. The side magnetizer 215 is a permanent magnet that arranges the magnetic domains in the first magnet 210 such that the magnetic field in the first magnet 210 increases. The side magnet cover 205 is configured to cover and hold the first magnet 210 and the side magnetizer 215 within the housing 105 of the lighting device 100. Likewise, the second magnetic element 185B includes a cap magnet cover 220, a second magnet 225, and a cap magnetizer 230. The cap magnetizer 230 is a permanent magnet that arranges the magnetic domains in the second magnet 225 such that the magnetic field in the second magnet 225 increases. The cap magnet cover 220 is configured to cover and hold the second magnet 225 and the cap magnetizer 230 within the battery cap 125 of the lighting device 100. The covers 205, 220 may be made of a relatively softer material than the magnets 210, 225, such as plastic or elastomeric material, so that the covers 205, 220 do not mar the surfaces to which the magnetic elements 185A, 185B are attached.

Figure 10:
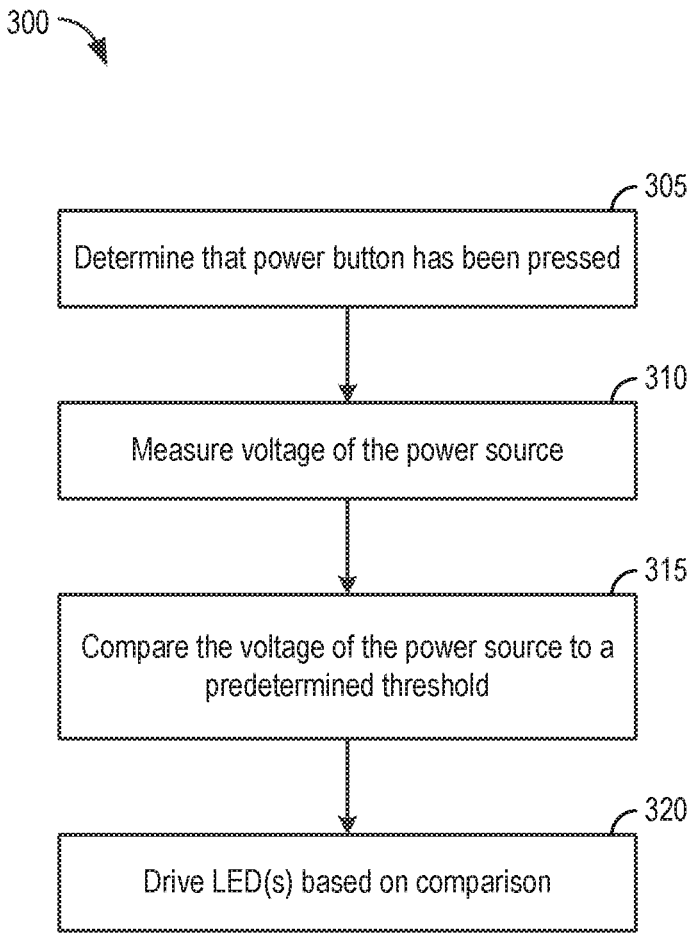
FIG. 10 is a flowchart illustrating a method of operating the lighting device.

FIG. 10 is a flowchart illustrating a method 300 of operating the lighting device 100. When the power button 115 is depressed (block 300), the PCB 175 first measures a charge remaining in the power source 145 (block 310). The measured remaining charge is then compared to a predetermined threshold (block 315) to determine whether the lighting device 100 is capable of being operated in the operation mode selected by the power button 115 (block 320). If the PCB 175 attempts to operate the lighting device 100 in a mode requiring a drive current that exceeds the available charge in the power source 145, the lighting device 100 will automatically switch to the next mode that requires a lower drive current in the operation cycle. For example, the lighting device 100 will automatically switch from the HIGH mode to the LOW mode and from the LOW mode to the OFF mode when charge remaining in the power source 145 is insufficient to support the required HIGH mode and LOW mode drive currents, respectively.

In some embodiments, the power source 145 comprises one or more alkaline batteries (see FIG. 9) received by the carrier 160. When the batteries become partially depleted, the alkaline chemistry changes and increases the internal impedance of the power source 145. Therefore, the lighting device 100 experiences a large voltage drop when attempting to draw full power from a partially depleted power source 145. Although the power source 145 may still have 50% charge remaining, the large voltage drop resulting from the increased internal impedance may cause the lighting device 100 to prematurely enter the LOW mode, which undesirably decreases the intensity of the light outputted by the light source 110 and shortens the operation time in the HIGH mode.

Figure 11:
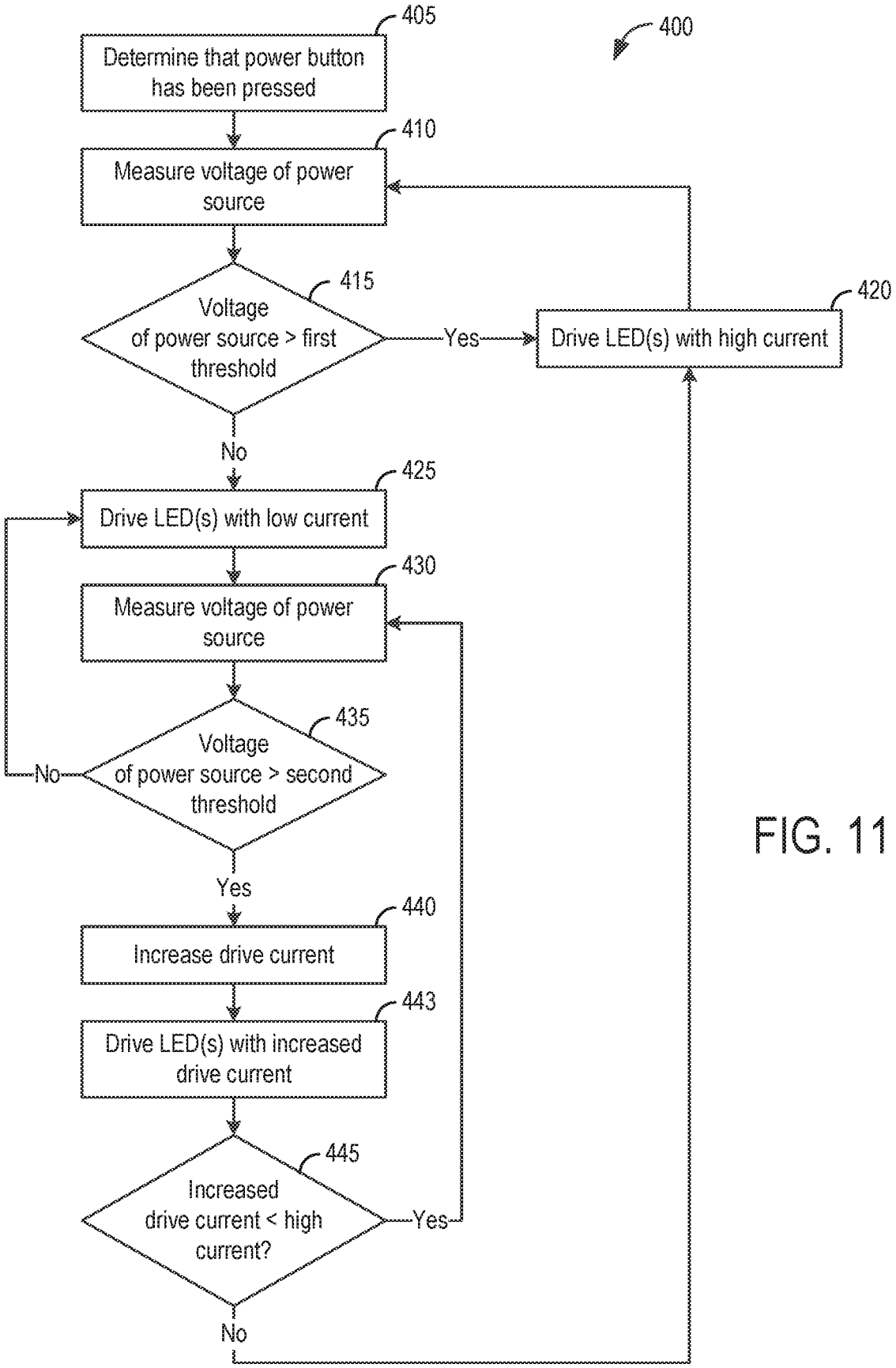
FIG. 11 is a flowchart illustrating a method of operating a ramp-up algorithm for the lighting device according to one embodiment.

In the illustrated embodiment, instead of attempting to initially draw full power from a partially depleted power source 145, the PCB 175 executes a ramp-up algorithm 400, as shown in FIG. 11, to incrementally ramp-up the drive current delivered to the LEDs 170 when the power source 145 is partially depleted. With such an arrangement, the light outputted by the light source 110 is optimized in relation to the remaining charge on the power source 145.

Referring to FIG. 11, when the power button 115 is initially pressed (block 405), the PCB 175 executes the ramp-up algorithm 400 and measures the amount of charge remaining in the power source 145 (block 410) before generating a PWM signal to provide a substantially constant drive current/voltage to the LEDs 170. If the measured remaining charge in the power source 145 is above a first voltage threshold (e.g., 2.5 V) signifying more than 50% remaining charge in the power source 145 (decision 415), the LEDs 170 are driven with a high drive current (e.g., 820 mA) to operate in the lighting device 100 in the HIGH mode (block 420). The ramp-up algorithm 400 repeats blocks 410-420 to maintain operation in the HIGH mode until the measured remaining charge in the power source 145 is no longer above the first voltage threshold. When the remaining charge in the power source 145 falls below the first voltage threshold, the power source 145 is considered partially depleted and the LEDs 170 are driven with a low drive current (e.g., 165 mA) to operate at a "plateau" state (block 425).

In the "plateau" state, the remaining charge in the power source 145 is measured again (block 430). If the measured remaining charge in the power source 145 is not above a second threshold (e.g., 2.3 V) that is lower than the first voltage threshold, then the power source 145 is depleted too far to reasonably provide the high drive current necessary for the lighting device 100 to operate in the HIGH mode. Thus, the ramp-up algorithm 400 repeats blocks 425-430 to maintain operation in the "plateau" state. On the other hand, if the measured remaining charge in the power source 145 is above the second voltage threshold (decision 435), then the low drive current is incrementally increased (block 440) until the low current becomes equivalent to or greater than the high current (decision 445) and the lighting device 100 is operating in the HIGH mode (block 420). By incrementally increasing the drive current for a partially depleted power source 145, the ramp-up algorithm 400 works in conjunction with the mode selection operation of the power button 115 to avoid the large voltage drop and inhibit the lighting device 100 from prematurely dropping from the HIGH mode to the LOW mode.

Figure 12:
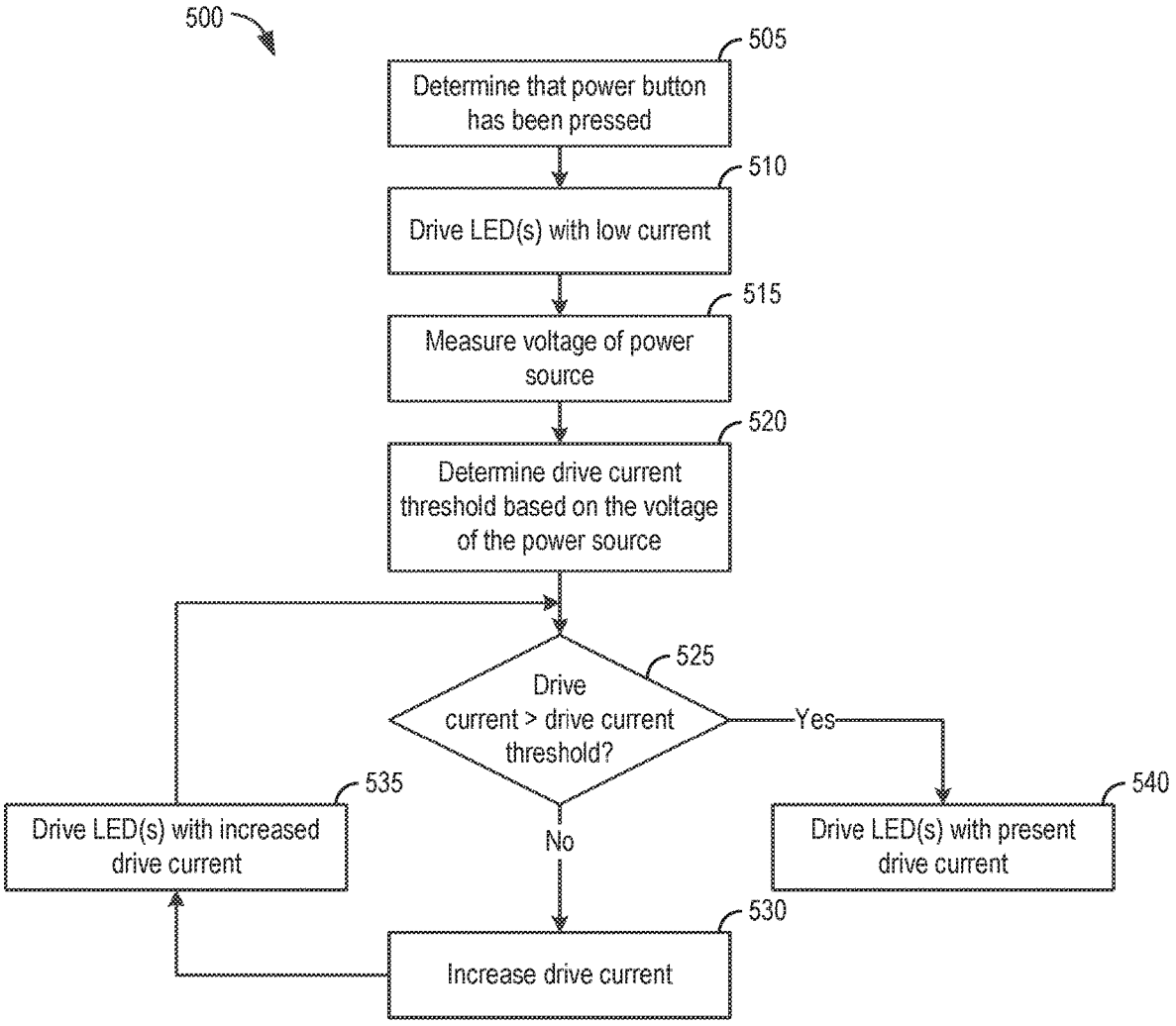
FIG. 12 is a flowchart illustrating a method of operating a ramp-down algorithm for the lighting device according to one embodiment.

In another embodiment, the lighting device 100 executes a ramp-up algorithm 500 as shown in FIG. 12. When the power button 115 is initially pressed (block 505), the PCB 175 provides a low drive current to the LEDs 170 regardless of the remaining charge available in the power source 145 such that the lighting device 100 is operated in the LOW mode (block 510). The remaining charge in the power source 145 is subsequently measured (block 515). Based on a function of the measured remaining charge, the PCB 175 selects a maximum light output that the lighting device 100 can reasonably achieve (block 520) and determines a current threshold based on the selected light output (block 525). As long as the present drive current provided to drive the LEDs 170 does not exceed the determined current threshold (decision 530), the ramp-up algorithm 500 incrementally increases the present drive current (block 535) and drives the LEDs 170 with the incremented present drive current (block 540) so that the intensity of the light emitted by the lighting device 100 is increased. Decision 530 and blocks 535-540 are repeated until the present drive current provided to drive the LEDs 170 exceeds the determined current threshold, signifying that the selected maximum light output is achieved. At this point, the ramp-up algorithm 500 drives the LEDs 170 with the present drive current to maintain the selected maximum light output (block 545).

Alternatively, other embodiments of the ramp-up algorithm 500 may exclude block 510 of FIG. 12. After the power button 115 is initially pressed (block 505), a remaining charge in the power source 145 is measured (block 515) and used to select a maximum light output (block 520) and determine a current threshold (block 525) before a drive current is provided to drive the LEDs 170. In such embodiments, the lighting device 100 allows ramping up of the emitted light intensity from the OFF mode as opposed to the LOW mode.

It should be understood that in some embodiments, the ramp-up algorithm 400, 500 may incrementally increase the drive current in a predetermined number of steps (e.g., 10 steps) such that execution of each step increases the drive current by a predetermined amperage (e.g., 100 mA). In other embodiments, the ramp-up algorithm 400, 500 may execute a continuous function increase such that the drive current is continuously increased over time with zero or infinite number of steps. Other methods of increasing the drive current in the ramp-up algorithm 400, 500 are possible to achieve the same purpose and are not exhaustively detailed herein.

The lighting device 100 may also implement a ramp-down algorithm according to some embodiments. The ramp-down algorithm may be implemented in the lighting device 100 to slowly decrease the drive current and the corresponding lumen output according to a function of time, a function of the remaining charge in the power source 145, or a function of both time and remaining charge.

Figure 13:
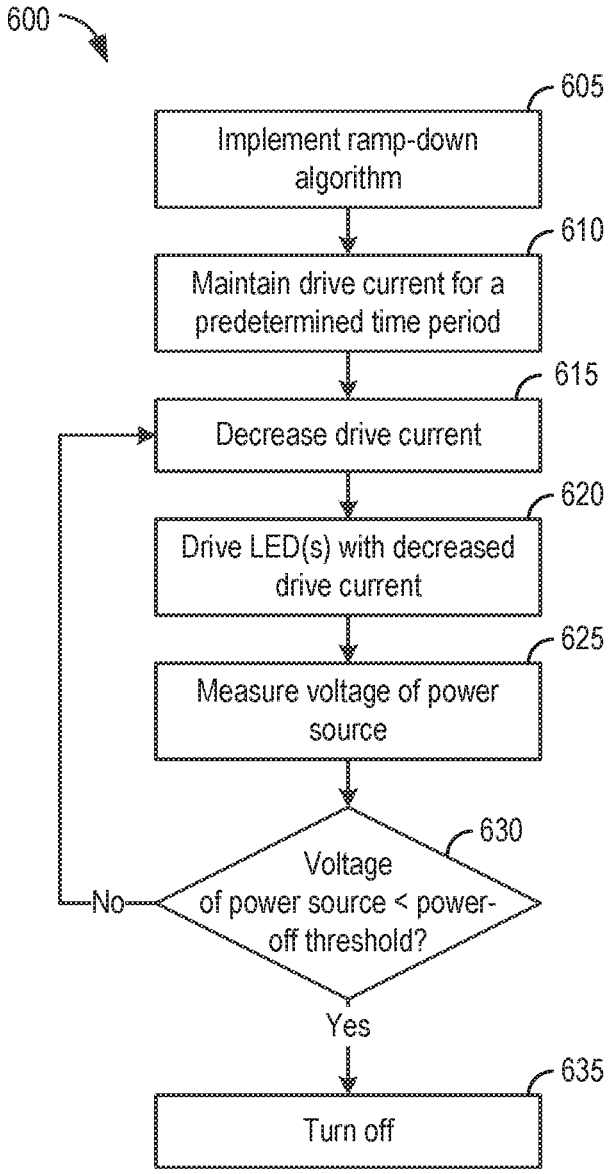
FIG. 13 is a flowchart illustrating another method of operating a ramp-down algorithm for the lighting device.

FIG. 13 is a flowchart illustrating one embodiment of a ramp-down algorithm 600 implemented according to a function of time. After the lighting device 100 achieves either the operation mode selected by the power button 115 or the highest possible lumen output from execution of the ramp-up algorithm 400, 500, the PCB 175 implements the ramp-down algorithm 600 (block 605). The drive current is initially maintained over a relatively short time period (block 610), during which the duty cycle of the PWM signal provided to the LEDs 170 is held at a constant high percentage (e.g., 100% if the HIGH mode is selected and achieved). After the initial time period has lapsed, the drive current is incrementally decreased over a relatively long time interval by reducing the percentage of the PWM duty cycle provided to the LEDs 170 (block 615). The decreased drive current drives the LEDs 170 over the time interval to provide a corresponding lumen output that is decreasing in intensity (block 620). During this time interval, the remaining charge in the power source 145 is measured (block 625) and compared to a power-off threshold (decision 630). If the measured remaining charge falls below the power-off threshold (e.g., 2.8 V), the power source 145 has been depleted beyond a reasonable operating range and the lighting device 100 will turn to the OFF mode (block 635). Otherwise, blocks 615-625 and decision 630 are repeated until the measured remaining charge in the power source 145 falls below the power-off threshold, thereby turning the lighting device 100 OFF (block 635). With each iteration of block 615, the length of the time interval may increase or decrease in various embodiments, as described in the example below.

In an exemplary implementation of the ramp-down algorithm 600, the ramp-down process is divided into five stages. In the first stage, the PCB 175 maintains the drive current provided to drive the LEDs 170 at 100% PWM duty cycle for a time period of 90 seconds (block 610). This ensures that the lighting device 100 is consistently operated in the HIGH mode for the initial 90 seconds. In the second stage, the drive current is reduced to 47.0% PWM duty cycle over a time interval of 3.7 minutes (block 615) such that the LEDs 170 are driven at 47.0% PWM drive current over the 3.7 minutes (block 620). During this time interval, the PCB 175 measures a remaining charge in the power source 145 (block 625) and compares the measured remaining charge to a power-off threshold of 2.8 V (decision 630). If the measured remaining charge in the power source 145 falls below 2.8 V at any time within the 3.7 minutes, the lighting device 100 will turn to the OFF mode (block 635). Otherwise, the lighting device 100 enters the third stage, wherein the ramp-down process is repeated. In the third stage, the drive current is further reduced to 20.6% PWM duty cycle over a time interval of 20 minutes (block 615) such that the LEDs 170 are driven at 20.6% PWM drive current over the 20 minutes (block 620). The remaining charge in the power source 145 is measured (block 625) and compared to the power-off threshold of 2.8 V (decision 630) to determine whether the lighting device 100 should enter the OFF mode (block 635). In stage four, the duty cycle of the PWM drive current is reduced over a time interval of 4.8 minutes (block 615) until the LEDs 170 are driven with 125 mA over the time interval of 4.8 minutes (block 620). As long as the measured remaining charge in the power source 145 (block 625) does not fall below 2.8 V (decision 630), the lighting device 100 will continue to execute the ramp-down algorithm 600 and remain powered on. In stage five, the PCB 175 maintains the drive current at 125 mA (block 620) until the measured remaining charge reaches 2.8 V (decision 630), thereby turning off the lighting device 100 (block 635). It should be understood that the number of stages, the PWM percentages, and the power-off threshold values detailed in this exemplary implementation of the ramp-down algorithm 600 may vary in other embodiments not exhaustively detailed herein.

Alternatively, other embodiments of the ramp-down algorithm 600 may drive the LEDs 170 with an incrementally decreasing drive current until a specified "plateau" threshold is reached, after which the drive current is held constant.

Once the drive current reaches the specified "plateau" threshold and is no longer decreased, the remaining charge in the power source 145 is continuously measured and compared to a low voltage threshold (e.g., 10%). If the measured remaining charge falls below the low voltage threshold, the ramp-down algorithm 600 decreases the specified "plateau" threshold and begins decreasing the drive current again until the new "plateau" threshold is reached. Subsequently, the drive current is held constant at that new "plateau" threshold. The remaining charge in the power source is again continuously measured and compared to a predetermined power-off threshold (e.g., 2.8 V). If the measured remaining charge falls below the power-off threshold, the lighting device 100 will turn to the OFF mode. The power-off threshold may vary in different embodiments depending on factors such as the characteristics of the power source 145 used by the lighting device 100.

It should be understood that similar to the ramp-up algorithm 400, 500 detailed above, the ramp-down algorithm 600 may also incrementally decrease the drive current in a predetermined number of steps or as a continuous function with zero or infinite number of steps. Other methods of implementing the ramp-down algorithm 600 based on factors other than time and/or remaining charge are possible to achieve the same purpose and are not exhaustively detailed herein.

In some embodiments, other types of batteries, such as lithium ion batteries, may be used as the power source 145. In such embodiments, similar ramp-up algorithms may still be employed, even though the lithium-ion chemistries may not experience as large of voltage drops as alkaline chemistries. Furthermore, it should be understood that other additional voltage thresholds may be used in the ramp-up algorithm 400 described above to further control operations of the lighting device 100. The lighting device 100 may also include additional components in other embodiments not exhaustively detailed herein to achieve the same purpose, and thus would not deviate from the teachings of the present application.

One or more independent features and/or independent advantages of the portable lighting device may be set forth in the claims.

What is claimed is:

1. A portable lighting device comprising:

a housing defining a first end, a second end, a plurality of longitudinally-extending surfaces extending between the first end and the second end, a longitudinal axis extending between the first end and the second end, each of the plurality of longitudinally-extending surfaces extending generally parallel to the longitudinal axis;

a light source supported by the housing and configured to emit light through a first of the plurality of longitudinally-extending surfaces of the housing in an outward direction that is normal to the longitudinal axis;

a power source positioned within the housing and coupled to the light source; and a clip rotatably coupled to the housing and having a substantially flat section, the clip being rotatable between a first position in which the substantially flat section is positioned adjacent a second of the plurality of longitudinally-extending surfaces of the housing and a second position in which the substantially flat section is positioned adjacent a third of the plurality of longitudinally-extending surfaces of the housing, the substantially flat section being configured to serve as a stand that supports an entire weight of the portable lighting device above a surface independent of the housing in both the first position and the second position.

2. The portable lighting device of claim 1, wherein each of the plurality of longitudinally-extending surfaces meets at corner areas with adjacent longitudinally-extending surfaces such that the housing forms a generally elongated cuboidal shape, wherein the light source is coupled to one of the plurality of longitudinally-extending surfaces, and wherein each of the plurality of longitudinally-extending surfaces is oriented at different angles relative to the light source to support the portable lighting device at different orientations.

3. The portable lighting device of claim 1, further comprising an actuator supported by the housing and a controller positioned within the housing, the controller being in communication with the light source, the power source, and the actuator.

4. The portable lighting device of claim 3, wherein the controller is configured to:

determine that the actuator has been actuated, determine whether an amount of charge remaining in the power source is greater than a first threshold or a second threshold, the first threshold being greater than the second threshold, drive the light source at a first current when the amount of charge is greater than the first threshold, drive the light source at a second current when the amount of charge drops below the first threshold, and incrementally increase the second current when the amount of charge is above the second threshold.

5. The portable lighting device of claim 3, wherein the controller is configured to:

determine that the actuator has been actuated, drive the light source at a first current in response to actuation of the actuator, determine an amount of charge remaining in the power source, determine a maximum light output of the light source and a current threshold based on the maximum light output, and incrementally increase the first current when the first current is below the current threshold.

6. The portable lighting device of claim 1, wherein a magnetic element is coupled to the housing, the magnetic element being disposed on one of a side of the housing opposite from the light source or in a cap coupled to a first end of the housing, the cap being selectively removable from the housing by a locking mechanism.

7. The portable lighting device of claim 1, wherein the clip includes a coupling section having an aperture that receives a portion of the housing, the substantially flat section extending from the coupling section parallel to the longitudinal axis.

8. The portable lighting device of claim 7, wherein the housing is rotatable while being supported by the clip.

9. A portable lighting device comprising:

a housing defining a longitudinal axis;

a first support mechanism coupled to the housing;

a second support mechanism coupled to the housing;

a light source supported by the housing, the light source being configured to be supported in a plurality of orientations by the first and the second support mechanisms; and a power source positioned within the housing and coupled to the light source, wherein the second support mechanism is a magnetic element, the magnetic element including a magnet cover, a magnet, and a magnetizer.

10. The portable lighting device of claim 9, wherein the first support mechanism is a clip rotatably coupled to the housing, the clip including a coupling section having an aperture that receives a portion of the housing and a substantially flat section extending from the coupling section, the substantially flat section configured to serve as a resting surface.

11. The portable lighting device of claim 10, wherein the housing is rotatable while being supported by the clip.

12. The portable lighting device of claim 9, wherein the magnetic element is disposed on a side of the housing opposite from the light source or in a cap that is removably coupled to the housing by a locking mechanism.

13. A portable lighting device comprising:

a housing defining a longitudinal axis;

a light source supported by the housing;

a power source positioned within the housing and coupled to the light source;

a cap removably coupled to a first end of the housing to enclose the power source, the cap removable from the first end of the housing to provide access to the power source;

a clip rotatably coupled to the housing;

a first magnetic element disposed on a side of the housing opposite from the light source; and a second magnetic element disposed in the cap.

14. The portable lighting device of claim 13, wherein the clip includes a coupling section having an aperture that receives a portion of the housing and a substantially flat section extending from the coupling section, the substantially flat section configured to serve as a resting surface.

15. The portable lighting device of claim 14, wherein the housing includes a first end, a second end opposite the first end, a plurality of longitudinally-extending surfaces extending between the first end and the second end, wherein each of the plurality of longitudinally-extending surfaces extends generally parallel to the longitudinal axis and meets at corner areas with adjacent longitudinally-extending surfaces such that the housing forms a generally elongated cuboidal shape, and wherein the light source is coupled to one of the plurality of longitudinally-extending surfaces.

16. The portable lighting device of claim 15, wherein the clip is positionable in:

a first position in which the substantially flat section is positioned adjacent a first of the plurality of longitudinally-extending surfaces of the housing, a second position in which the substantially flat section is positioned adjacent a second of the plurality of longitudinally-extending surfaces, and an intermediate position in which the substantially flat section is positioned between the first and second positions.

17. The portable lighting device of claim 15, wherein the clip is positionable adjacent one or more of the longitudinally-extending surfaces and positionable between one or more of the longitudinally-extending surfaces.

18. The portable lighting device of claim 7, wherein the coupling section is positioned within a slot defined by the housing, a cap coupled to the housing, or between the housing and the cap.

19. A portable lighting device comprising:

a housing defining a longitudinal axis;

a light source supported by the housing;

a power source positioned within the housing and coupled to the light source;

an actuator supported by the housing; and a controller positioned within the housing, the controller being in communication with the light source, the power source, and the actuator, wherein the controller is configured to:

determine that the actuator has been actuated, determine whether an amount of charge remaining in the power source is greater than a first threshold or a second threshold, the first threshold being greater than the second threshold, drive the light source at a first current when the amount of charge is greater than the first threshold, drive the light source at a second current when the amount of charge drops below the first threshold, and incrementally increase the second current when the amount of charge is above the second threshold.

20. A portable lighting device comprising:

a housing defining a longitudinal axis;

a light source supported by the housing;

a power source positioned within the housing and coupled to the light source;

an actuator supported by the housing; and a controller positioned within the housing, the controller being in communication with the light source, the power source, and the actuator, wherein the controller is configured to:

determine that the actuator has been actuated, drive the light source at a first current in response to actuation of the actuator, determine an amount of charge remaining in the power source, determine a maximum light output of the light source and a current threshold based on the maximum light output, and incrementally increase the first current when the first current is below the current threshold.

* * * * *